US009689049B2

(12) United States Patent
Matsumoto

(10) Patent No.: US 9,689,049 B2
(45) Date of Patent: Jun. 27, 2017

(54) ELECTRIC HEATING DEVICE

(75) Inventor: Shin'ichiroh Matsumoto, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 158 days.

(21) Appl. No.: 14/238,064

(22) PCT Filed: Sep. 13, 2011

(86) PCT No.: PCT/JP2011/070849

§ 371 (c)(1),
(2), (4) Date: Feb. 10, 2014

(87) PCT Pub. No.: WO2013/038499

PCT Pub. Date: Mar. 21, 2013

(65) Prior Publication Data

US 2014/0209597 A1 Jul. 31, 2014

(51) Int. Cl.
*C21D 1/40* (2006.01)
*H05B 3/02* (2006.01)
(Continued)

(52) U.S. Cl.
CPC ..... *C21D 1/40* (2013.01); *H05B 3/0023* (2013.01); *H05B 3/023* (2013.01); *C21D 9/46* (2013.01); *H05B 2203/016* (2013.01)

(58) Field of Classification Search
CPC .... H05B 3/023; H05B 3/0023; H05B 3/0004; H05B 2203/016; C21D 1/40; C21D 9/46
See application file for complete search history.

(56) References Cited

U.S. PATENT DOCUMENTS 6,463,779 B1 * 10/2002 Terziakin ..... B21D 37/16 148/567
6,897,407 B2 * 5/2005 Gomez ..... C21D 1/40 219/156

(Continued)

FOREIGN PATENT DOCUMENTS

JP S5065406 A 6/1975
JP S5753594 U 3/1982

(Continued)

OTHER PUBLICATIONS

Dec. 16, 2014 Office Action issued in Japanese Patent Application No. 2013-533379.

*Primary Examiner* — Tu B Hoang
*Assistant Examiner* — Erin McGrath
(74) *Attorney, Agent, or Firm* — Oliff PLC

(57) ABSTRACT

Disclosed is an electric heating device capable of uniformly applying an electric current to a workpiece without causing abrasion of electrodes. An electric heating device includes a pair of electrodes for applying an electric current to a workpiece, and a pair of clamps for fixing the workpiece. The electrode extends along the surface of the workpiece in a direction perpendicular to an electric current direction while maintaining a constant length in the electric current direction, and sandwiches the workpiece therein. The clamp is arranged in the vicinity of the electrode, and sandwiches a part of the workpiece other than a part to be heated therein. A pressure at which the clamp sandwiches the workpiece therein is higher than a pressure at which the electrode sandwiches the workpiece therein.

6 Claims, 4 Drawing Sheets

(51) Int. Cl.
*H05B 3/00* (2006.01)
*C21D 9/46* (2006.01)

(56) References Cited

U.S. PATENT DOCUMENTS

2006/0291527 A1* 12/2006 Callahan ..... F24H 1/106
373/108
2008/0197117 A1* 8/2008 Jin ..... B21D 39/034
219/78.15
2010/0264129 A1* 10/2010 Ishiguro ..... C21D 1/34
219/546
2012/0153688 A1* 6/2012 Gerken ..... H05B 3/06
297/180.12

FOREIGN PATENT DOCUMENTS

JP A-2007-118014 5/2007
JP A-2009-142853 7/2009

* cited by examiner

ELECTRIC HEATING DEVICE

TECHNICAL FIELD

The present invention relates to an electric heating device for applying an electric current to a flat plate-like workpiece to heat the workpiece.

BACKGROUND ART

Conventionally, a hot-press forming is publicly known in which, after heating a workpiece, such as a steel plate, to above a temperature at which an austenite structure appears therein, cooled dies press and quench the workpiece at the same time.

In the above-mentioned hot-press forming, electric heating is widely known as a technique for heating the workpiece (for example, see Patent Literature 1).

The electric heating is a technique for heating the workpiece by utilizing Joule heat generated by applying an electric current to the workpiece with at least one pair of electrodes attached to the workpiece.

In the electric heating, the heated workpiece thermally expands, and deforms. Therefore, it is necessary to control the deformation of the workpiece to a minimum by bringing the electrodes into contact with the workpiece at a predetermined pressure to fix the workpiece.

However, the electrode used for the electric heating abrades by friction and the like because the electrode comes in contact with the workpiece at such a high pressure as to control the deformation of the workpiece to a minimum as mentioned above. When the electrode abrades, the abraded part of the electrode does not closely come in contact with the workpiece, which makes it impossible to uniformly apply an electric current to the workpiece. Moreover, the abraded part of the electrode, namely, the part of the electrode which does not closely come in contact with the workpiece sparks, which may cause problem that the electrode melts and chips for example.

CITATION LIST

Patent Literature

Patent Literature 1: JP 2009-142853 A

SUMMARY OF INVENTION

Problem to be Solved by the Invention

The objective of the present invention is to provide an electric heating device capable of uniformly applying an electric current to a workpiece without causing abrasion of electrodes.

Means for Solving the Problem

A first aspect of the invention is an electric heating device for applying an electric current to a plate-like workpiece having two flat surfaces parallel to each other to heat the workpiece, includes a pair of electrodes for applying the electric current to the workpiece, which is arranged at a predetermined interval in an electric current direction in which the electric current is applied to the workpiece, and a pair of clamps for fixing the workpiece. Each of the electrodes extends along the two surfaces of the workpiece in a direction perpendicular to the electric current direction while maintaining a constant length in the electric current direction, and sandwiches the workpiece therein so as to press the two surfaces of the workpiece. Each of the clamps is arranged in a vicinity of each of the electrodes, and sandwiches a part of the workpiece other than a part to be heated therein so as to press the two surfaces of the workpiece. A pressure at which each of the clamps sandwiches the workpiece therein is higher than a pressure at which each of the electrodes sandwiches the workpiece therein.

Preferably, the pressure at which each of the clamps sandwiches the workpiece therein is such a high value that the pair of clamps may minimize deformation of the workpiece which is heated when the pair of electrodes applies the electric current to the workpiece, and the pressure at which each of the electrodes sandwiches the workpiece therein is such a low value that the pair of electrodes may apply the electric current to the workpiece.

Preferably, a length in the electric current direction of each of the electrodes is such a small value that stiffness of each of the electrodes is retained.

Preferably, the length in the electric current direction of each of the electrodes is 0.5 to 3 [mm].

Effects of the Invention

The present invention makes it possible to uniformly apply an electric current to a workpiece without causing abrasion of electrodes.

DESCRIPTION OF EMBODIMENTS

Figure 1:
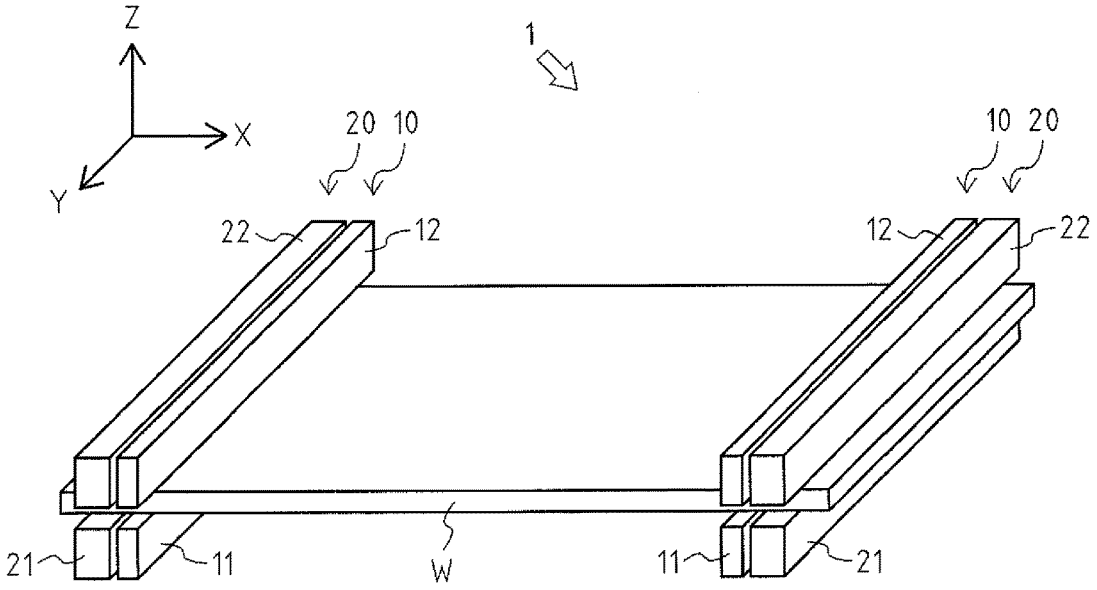
FIG. 1 illustrates an electric heating device according to an embodiment of the present invention.

With reference to FIG. 1, described below is an electric heating device 1 as an embodiment of an electric heating device according to the present invention.

The electric heating device 1 applies an electric current to a workpiece W to heat the workpiece W.

For convenience, it is assumed that an arrow X in FIG. 1 indicates a right direction of the workpiece W to define a right-left direction. Moreover, it is assumed that an arrow Y in FIG. 1 indicates a front direction of the workpiece W to define a front-rear direction. Additionally, it is assumed that an arrow Z in FIG. 1 indicates a top direction of the workpiece W to define a top-bottom direction.

As shown in FIG. 1, the workpiece W is a rectangular flat plate whose longitudinal direction corresponds to the right-left direction, and both the surfaces thereof face in the top-bottom direction. The workpiece W is to be heated by the electric heating device 1, and is made of a conductive material such as a steel plate.

The electric heating device 1 includes a pair of electrodes 10 and a pair of clamps 20.

The pair of electrodes 10 is used for applying an electric current to the workpiece W, and is arranged at a predetermined interval in the right-left direction. The pair of electrodes 10 fixed to the vicinities of both the ends in the right-left direction of the workpiece W. One of the pair of electrodes 10 is used as a positive electrode, and the other is used as a negative electrode. The pair of electrodes 10 is used in pairs, and is similarly used even in the case of using an alternating current power source. Note that the pair of electrodes 10 is connected to a predetermined power supply. The power supply is run, and thereby the pair of electrodes 10 applies an electric current to the workpiece W in the right-left direction. In other words, in the electric heating device 1, an electric current direction corresponds to the right-left direction.

The electrode 10 is made of a conductive material such as copper, stainless steel, and graphite. However, it is preferable that copper (in particular, chromium copper, or beryllium copper) is adopted as a material of the electrode 10 in terms of high durability, low electric resistance, and the like.

The electrode 10 has a lower electrode 11 positioned below the workpiece W, and an upper electrode 12 positioned above the workpiece W.

The lower electrode 11 is formed in a rectangular cuboid. The lower electrode 11 extends, while maintaining a constant top-bottom dimension and a constant right-left dimension (length in the electric current direction) thereof, in the front-rear direction (extends along the surface of the workpiece W in a direction perpendicular to the direction in which an electric current is applied) so that a front-rear dimension of the lower electrode 11 is larger than that of the workpiece W. The lower electrode 11 is fixed at a predetermined position so that the workpiece W is placed thereon. The workpiece W is placed on the lower electrode 11 so that the top surface of the lower electrode 11 comes in contact with the bottom surface of the workpiece W, and that both the ends in the front-rear direction of the workpiece W are positioned between both the ends in the front-rear direction of the lower electrode 11. The surface of the lower electrode 11 in contact with the workpiece W, namely, the top surface of the lower electrode 11 is flat surface which closely comes in contact with the bottom surface of the workpiece W.

The upper electrode 12 is formed in a rectangular cuboid similarly to the lower electrode 11. The upper electrode 12 extends in the front-rear direction while maintaining a top-bottom dimension thereof equal to that of the lower electrode 11 and a right-left dimension thereof equal to that of the lower electrode 11 so that a front-rear dimension of the upper electrode 12 is equal to that of the lower electrode 11. The upper electrode 12 is arranged on the opposite side of the lower electrode 11 across the workpiece W. The upper electrode 12 is configured to be moved in the top-bottom direction by an actuator such as an air cylinder. The bottom surface of the upper electrode 12 is brought into contact with the top surface of the workpiece W so that the upper electrode 12 and the lower electrode 11 sandwich the workpiece W therebetween from above and below. The surface of the upper electrode 12 in contact with the workpiece W, namely, the bottom surface of the upper electrode 12 is flat surface which closely comes in contact with the top surface of the workpiece W.

In the present embodiment, the lower electrode 11 is fixed, and the upper electrode 12 is movable. However, the lower electrode 11 may be movable and the upper electrode 12 may be fixed, or both the lower electrode 11 and the upper electrode 12 may be movable.

A right-left dimension (length in the electric current direction) of the electrode 10 is smaller than that of a conventional electrode.

Specifically, each of the right-left dimension of the lower electrode 11 and the right-left dimension of the upper electrode 12 is set to such a small value (e.g. 0.5 to 3 [mm]) that stiffness of the electrode 10 (the lower electrode 11 and the upper electrode 12) is retained. In other words, each of the right-left dimension of the lower electrode 11 and the right-left dimension of the upper electrode 12 is set to such a small value that the lower electrode 11 and the upper electrode 12 do not buckle when sandwiching the workpiece W therebetween.

The pair of clamps 20 fixes the workpiece W. The pair of clamps 20 is arranged in the vicinities of the pair of electrodes 10, and fixes the parts of the workpiece W other than the part to be heated (part situated between the pair of electrodes 10). Specifically, one of the clamps 20 is arranged to the left of the left electrode 10 slightly away from the left electrode 10, and the other is arranged to the right of the right electrode 10 slightly away from the right electrode 10. In other words, the pair of clamps 20 is arranged outside in the right-left direction of the pair of electrodes 10.

The clamp 20 is made of a material with high hardness such as stainless steel and carbon steel.

The clamp 20 has a lower clamp 21 positioned below the workpiece W, and an upper clamp 22 positioned above the workpiece W.

The lower clamp 21 is formed in a rectangular cuboid. The lower clamp 21 extends in the front-rear direction while maintaining a constant top-bottom dimension and a constant right-left dimension thereof so that a front-rear dimension of the lower clamp 21 is larger than that of the workpiece W. The lower clamp 21 is fixed at such a position that the top surface of the lower clamp 21 coincides in position in the top-bottom direction with the top surface of the lower electrode 11 so that the workpiece W is placed on the lower clamp 21. The workpiece W is placed on the lower clamp 21 so that the top surface of the lower clamp 21 comes in contact with the bottom surface of the workpiece W, and that both the ends in the front-rear direction of the workpiece W are positioned between both the ends in the front-rear direction of the lower clamp 21.

The upper clamp 22 is formed in a rectangular cuboid similarly to the lower clamp 21. The upper clamp 22 extends in the front-rear direction while maintaining a top-bottom dimension thereof equal to that of the lower clamp 21 and a right-left dimension thereof equal to that of the lower clamp 21 so that a front-rear dimension of the upper clamp 22 is equal to that of the lower clamp 21. The upper clamp 22 is arranged on the opposite side of the lower clamp 21 across the workpiece W. The upper clamp 22 is configured to be moved in the top-bottom direction by an actuator such as an air cylinder. The bottom surface of the upper clamp 22 is brought into contact with the top surface of the workpiece W so that the upper clamp 22 and the lower clamp 21 sandwich the workpiece W therebetween from above and below.

It is preferable that a pressure at which the upper clamp 22 presses the workpiece W (a pressure at which the clamp 20 sandwiches the workpiece W therein) is higher than a pressure at which the upper electrode 12 presses the workpiece W (a pressure at which the electrode 10 sandwiches the workpiece W therein).

It is more preferable that the pressure at which the upper clamp 22 presses the workpiece W (the pressure at which the clamp 20 sandwiches the workpiece W therein) is set to such a high value that the clamp 20 may minimize the deformation of the workpiece W which is heated when the pair of electrodes 10 applies an electric current to the workpiece W. In other words, the upper clamp 22 presses the workpiece W at such a pressure as to minimize the deformation of the workpiece W which is heated when the pair of electrodes 10 applies an electric current to the workpiece W, and to minimize decrease of a contact area between the workpiece W and the pair of electrodes 10, thereby fixing the workpiece W.

This makes it possible to minimize the deformation, caused by thermal expansion, of the workpiece W which is heated when the pair of electrodes 10 applies an electric current to the workpiece W, and to cause the pair of electrodes 10 to uniformly apply an electric current to the workpiece W.

In the present embodiment, the lower clamp 21 is fixed, and the upper clamp 22 is movable. However, the lower clamp 21 may be movable and the upper clamp 22 may be fixed, or both the lower clamp 21 and the upper clamp 22 may be movable.

The surfaces of the clamp 20 in contact with the workpiece W, namely, the top surface of the lower clamp 21 and the bottom surface of the upper clamp 22 are each formed in a shape with high frictional coefficient (formed as a bumpy surface, for example).

This makes it possible to suitably fix the workpiece W to be deformed by thermal expansion, and to further minimize the deformation of the workpiece W caused by thermal expansion.

In the electric heating device 1, since the clamp 20 fixes the workpiece W, the pressure at which the upper electrode 12 presses the workpiece W (the pressure at which the electrode 10 sandwiches the workpiece W therein) is set to such a low value that the bottom surface of the upper electrode 12 closely comes in contact with the top surface of the workpiece W, and that the pair of electrodes 10 may apply an electric current to the workpiece W. In other words, the upper electrode 12 presses the workpiece W at such a minimum pressure that the bottom surface of the upper electrode 12 closely comes in contact with the top surface of the workpiece W, and that the pair of electrodes 10 may apply an electric current to the workpiece W.

This makes it possible to minimize abrasion of the electrode 10 caused by bringing the electrode 10 into contact with the workpiece W.

In a conventional electric heating device, an electrode has both a function for applying an electric current to the workpiece, and a function for fixing the workpiece, and presses the workpiece at a pressure higher than the one necessary for applying an electric current thereto to minimize the deformation of the workpiece. On the other hand, in the electric heating device according to the present embodiment, an electrode has the function for applying an electric current to the workpiece, and a clamp has the function for fixing the workpiece. These functions are separated from each other.

In the present embodiment, the electrode 10 and the clamp 20 adjacent to each other are arranged at a slight interval, but may be arranged to come in contact with each other.

In other words, the "vicinity" of the electrode 10 means such a position that the clamp 20 may minimize the deformation of the heated workpiece W regardless of whether the clamp 20 is in contact with the electrode 10 or not.

With reference to FIGS. 2 to 7, described below are effects resulting from making a right-left dimension of the electrode smaller than that of a conventional electrode.

Figure 2:
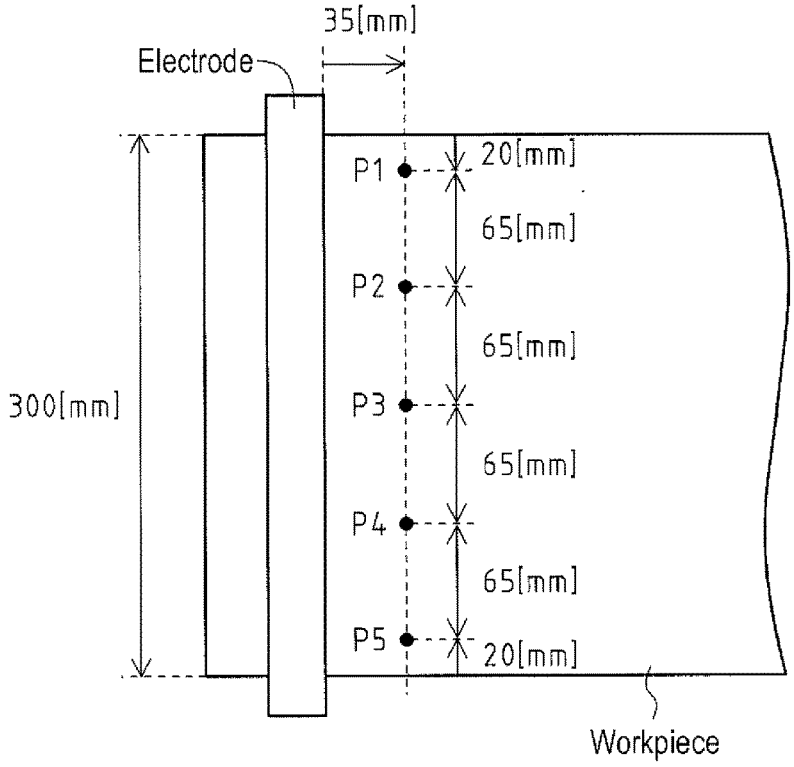
FIG. 2 illustrates points of a workpiece at which a temperature of the workpiece is measured in an experiment.

For convenience, a right-left direction in FIG. 2 is defined as a right-left direction of the workpiece. Moreover, an upper side in FIG. 2 is defined as a rear side of the workpiece, and a lower side in FIG. 2 is defined as a front side of the workpiece, thereby a front-rear direction of the workpiece being defined. Additionally, this side in FIG. 2 is defined as an upper side of the workpiece, and the far side in FIG. 2 is defined as a lower side of the workpiece, thereby a top-bottom direction of the workpiece being defined.

First, prepared were one pair of conventional electrodes each having a right-left dimension of 5 [mm], and three pairs of electrodes consisting of a first pair of electrodes each having a right-left dimension of 0.5 [mm], a second pair of electrodes each having a right-left dimension of 1 [mm], and a third pair of electrodes each having a right-left dimension of 3 [mm]. Then, an experiment in which each pair of electrodes applies an electric current to the workpiece was performed.

In the present experiment, the workpiece having a front-rear dimension of 300 [mm], a right-left dimension of 375 [mm], and a top-bottom dimension of 1.4 [mm] was used, and a distance between each pair of electrodes (a distance between opposed surfaces of the pair of electrodes) was set to 325 [mm].

As shown in FIG. 2, in the present experiment, temperatures of the workpiece after applying an electric current thereto were measured at measuring points P1, P2, P3, P4 and P5.

The measuring points P1 to P5 are 35 [mm] away from the left electrode fixed to the workpiece (from the right end surface of the left electrode, specifically).

A distance from the rear end of the workpiece to the measuring point P1, and a distance from the front end of the workpiece to the measuring point P5 are 20 [mm] each. A distance from the measuring point P1 to the measuring point P2, a distance from the measuring point P2 to the measuring point P3, a distance from the measuring point P3 to the measuring point P4, and a distance from the measuring point P4 to the measuring point P5 are 65 [mm] each.

In the present experiment, a step was performed three times in which each pair of electrodes applied an electric current of 12 [kA] to the workpiece for 11.5 seconds, and a difference between a minimum and a maximum of the temperatures at the measuring points P1 to P5 was calculated as a temperature width.

Figure 3:
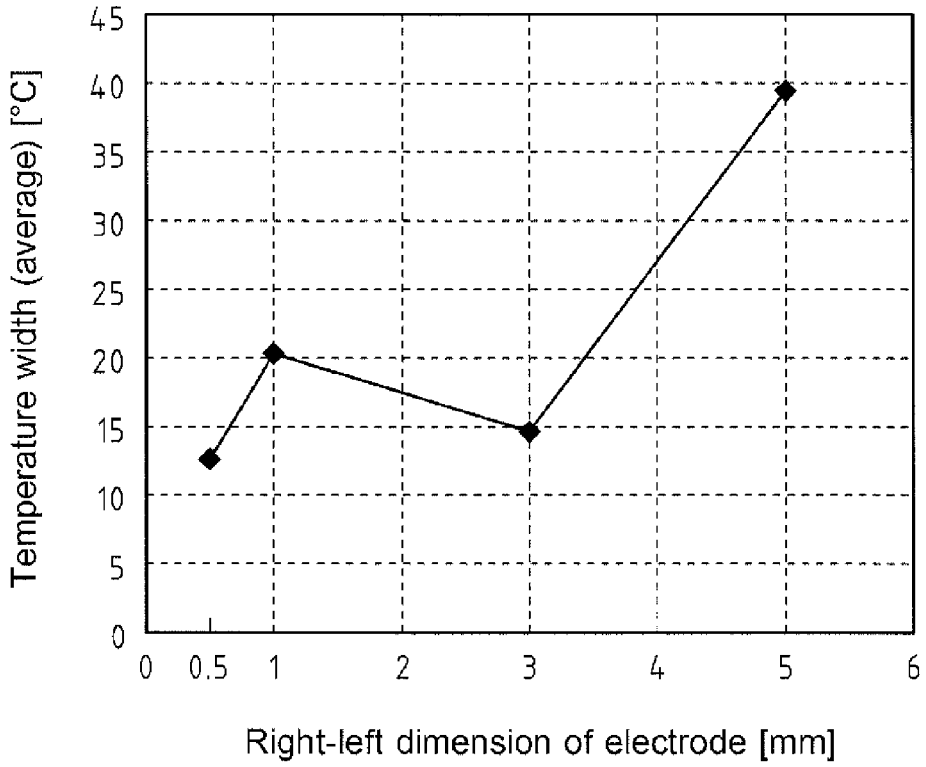
FIG. 3 shows a relationship between a right-left dimension of an electrode and an average of three temperature widths.

FIG. 3 shows an average (hereinafter referred to as "average temperature width") of three temperature widths calculated with each electrode.

As shown in FIG. 3, in the case where the right-left dimension of the electrode is equal to or smaller than 3 [mm], the average temperature width is relatively small, and every electrode results in generating substantially equal average temperature width.

Figure 4:
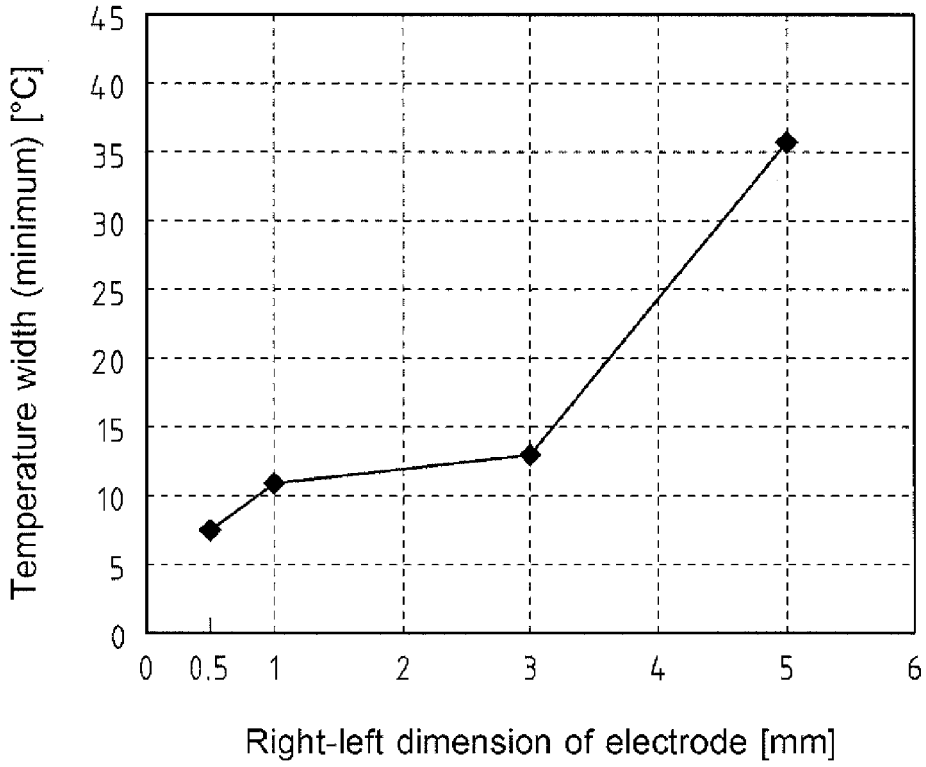
FIG. 4 shows a relationship between the right-left dimension of the electrode and a minimum of the three temperature widths.

FIG. 4 shows a minimum (hereinafter referred to as "minimum temperature width") of three temperature widths calculated with each electrode.

As shown in FIG. 4, in the case where the right-left dimension of the electrode is equal to or smaller than 3 [mm], the minimum temperature width is relatively small, and the minimum temperature width decreases with a decrease in right-left dimension of the electrode.

As mentioned above, it became clear that, if the electrode whose right-left dimension is equal to or smaller than 3 [mm] applied an electric current to the workpiece, the temperature width in the workpiece may be reduced, namely, variation of the temperature of the workpiece may be controlled to a minimum, compared with the case of using a conventional electrode with the right-left dimension of 5 [mm].

Next, a simulation was performed in which a pair of conventional electrodes each having the right-left dimension of 5 [mm] applied an electric current to the workpiece, and which a pair of electrodes each having the right-left dimension of 1 [mm] applied an electric current to the workpiece.

The present simulation was performed under the condition (e.g. dimension of the workpiece) similar to that of the above-mentioned experiment.

Figure 5:
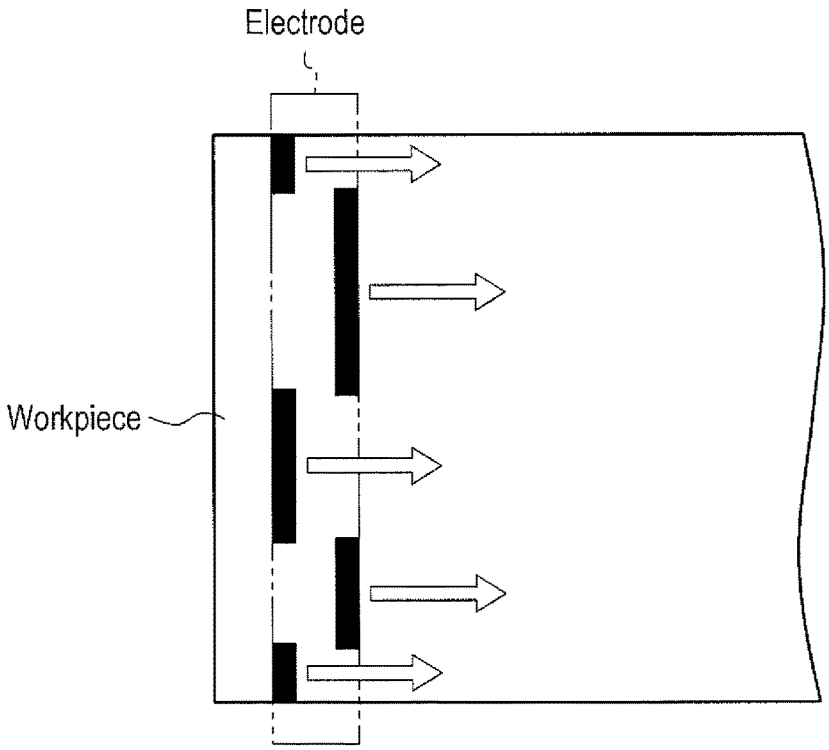
FIG. 5 illustrates parts of contact between the electrode and the workpiece in a simulation.

In the present simulation, as shown in FIG. 5, the electrode was formed to partly come in contact with the workpiece on the assumption that parts of the electrode out of contact with the workpiece exist.

Note that the black-painted parts in FIG. 5 represent parts of the electrode in contact with the workpiece, and the white-painted arrows in FIG. 5 indicate an electric current.

Figure 6:
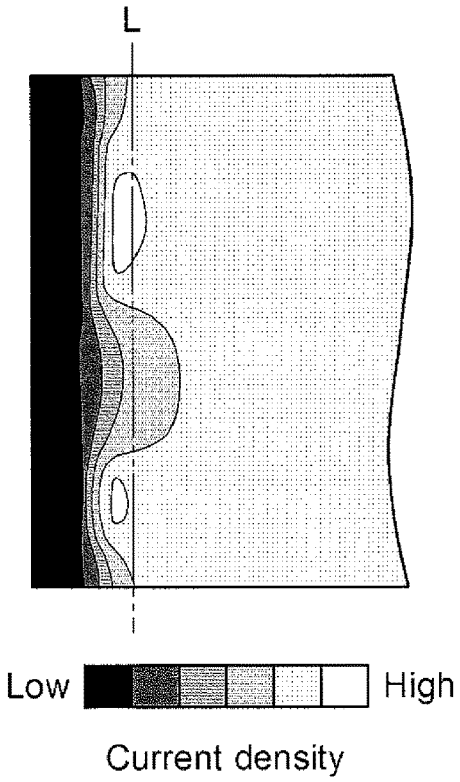
FIG. 6 shows distribution of current density which is generated when conventional electrodes apply an electric current to the workpiece.
Figure 7:
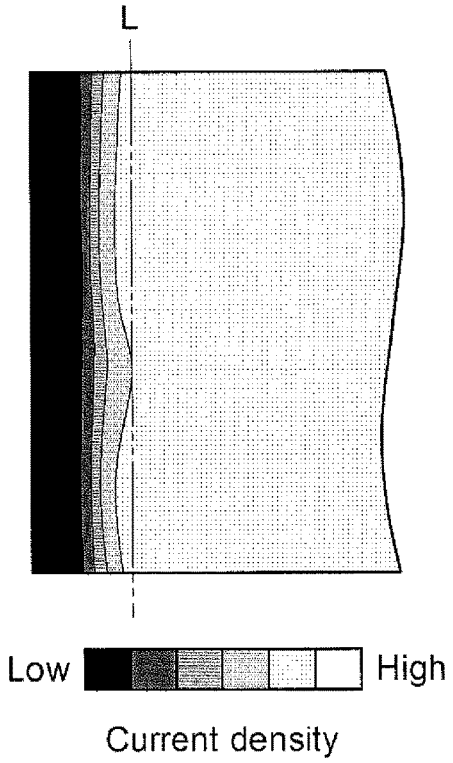
FIG. 7 shows distribution of current density which is generated when electrodes according to the present invention apply an electric current to the workpiece.

FIG. 6 shows distribution of current density in the workpiece to which the pair of conventional electrodes each having the right-left dimension of 5 [mm] has applied an electric current. FIG. 7 shows distribution of current density in the workpiece to which the pair of electrodes each having the right-left dimension of 1 [mm] has applied an electric current.

Each of the two-dot chain lines L in FIGS. 6 and 7 represents a position 35 [mm] apart from the left electrode fixed to the workpiece (from the right end surface of the left electrode, specifically).

As shown in FIG. 6, when the pair of conventional electrodes each having the right-left dimension of 5 [mm] applied an electric current to the workpiece, variation of the current density varied widely in the position 35 [mm] apart from the left electrode fixed to the workpiece (in the position indicated by the two-dot chain line L).

As shown in FIG. 7, when the pair of electrodes each having the right-left dimension of 1 [mm] applied an electric current to the workpiece, variation of the current density varied slightly in the position 35 [mm] apart from the left electrode fixed to the workpiece (in the position indicated by the two-dot chain line L).

Thus, it became clear that making the right-left dimension of the electrode smaller than that of the conventional electrode, especially making the right-left dimension of the electrode 0.5 to 3 [mm] may mitigate the influence of the parts of the electrode which are out of contact with the workpiece, and consequently may keep applying an electric current unevenly to the workpiece under control.

Figure 8:
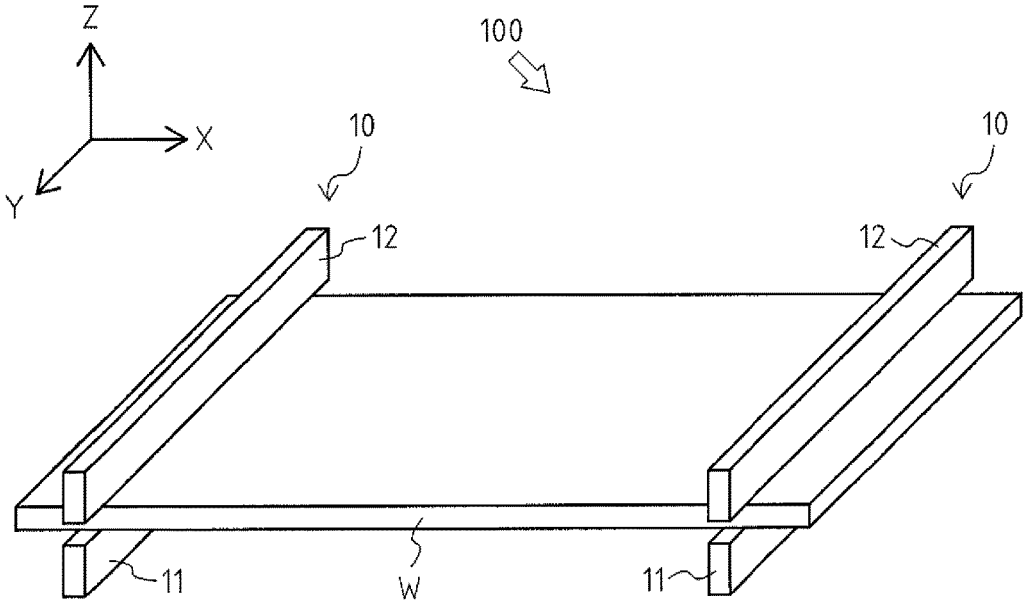
FIG. 8 illustrates another embodiment of the electric heating device.

With reference to FIG. 8, described below is an electric heating device 100.

The electric heating device 100 applies an electric current to the workpiece W to heat the workpiece W.

Hereinafter, the parts of the electric heating device 100 corresponding to those of the electric heating device 1 are indicated by same reference signs, and descriptions thereof are omitted.

The electric heating device 100 includes the pair of electrodes 10. In other words, the electric heating device 100 differs from the electric heating device 1 in not having the pair of clamps 20.

In the electric heating device 100, a pressure at which the upper electrode 12 presses the workpiece W (a pressure at which the electrode 10 sandwiches the workpiece W therein) is set to a value similar to that of the conventional electrode, namely, such a value that the pair of electrodes 10 may minimize the deformation of the workpiece which is heated when the pair of electrodes 10 applies an electric current to the workpiece.

As mentioned previously, the right-left dimension (length in the electric current direction) of the electrode 10 is smaller than that of a conventional electrode.

This makes it possible to reduce a contact area between the electrode 10 and the workpiece W, and consequently to increase a contact pressure between the electrode 10 and the workpiece W.

Therefore, it is possible to suitably minimize the deformation of the workpiece W caused by thermal expansion without increasing a pressure at which the electrode 10 sandwiches the workpiece W therein.

INDUSTRIAL APPLICABILITY

The present invention is applied to an electric heating device for applying an electric current to a flat plate-like workpiece to heat the workpiece.

REFERENCE SIGNS LIST

1: electric heating device
10: electrode
11: lower electrode
12: upper electrode
20: clamp
21: lower clamp
22: upper clamp
W: workpiece

The invention claimed is:

1. An electric heating device for applying an electric current to a plate-like workpiece having two largest flat surfaces parallel to each other to heat the workpiece, comprising:

a pair of electrodes for applying the electric current to the workpiece, the pair of electrodes being arranged at a predetermined interval in an electric current direction in which the electric current is applied to the workpiece; and a pair of clamps for fixing the workpiece directly, wherein each of the electrodes extends along the two largest flat surfaces of the workpiece in a direction perpendicular to the electric current direction while maintaining a constant length in the electric current direction, and sandwiches the workpiece therein so as to press the two largest flat surfaces of the workpiece, wherein each of the clamps is arranged in a vicinity of each of the electrodes, and sandwiches a part of the workpiece other than a part to be heated therein so as to press the two largest flat surfaces of the workpiece, each of the clamps fixing the workpiece outside of, in the electric current direction, the part of the workpiece sandwiched by the electrodes, wherein a pressure at which each of the clamps sandwiches the workpiece therein is higher than a pressure at which each of the electrodes sandwiches the workpiece therein, and wherein the electrodes and the clamps are provided separately and in a non-connected state from each other.

2. The electric heating device according to claim 1, wherein the pressure at which each of the clamps sandwiches the workpiece therein is such a high value that the pair of clamps minimizes deformation of the workpiece which is heated when the pair of electrodes applies the electric current to the workpiece, and wherein the pressure at which each of the electrodes sandwiches the workpiece therein is such a low value that the pair of electrodes applies the electric current to the workpiece.

3. The electric heating device according to claim 1, wherein a length in the electric current direction of each of the electrodes is such a small value that the electrodes do not buckle when sandwiching the workpiece therebetween.

4. The electric heating device according to claim 3, wherein the length in the electric current direction of each of the electrodes is 0.5 to 3 mm.

5. The electric heating device according to claim 2, wherein a length in the electric current direction of each of the electrodes is such a small value that the electrodes do not buckle when sandwiching the workpiece therebetween.

6. The electric heating device according to claim 5, wherein the length in the electric current direction of each of the electrodes is 0.5 to 3 mm.

* * * * *